United States Patent [19]

Frazier et al.

[11] Patent Number: 4,938,864

[45] Date of Patent: Jul. 3, 1990

[54] METHOD FOR PROCESSING FINE COAL

[75] Inventors: Clarence L. Frazier; Richard T. Burks, III, both of Lexington, Ky.

[73] Assignee: Mare Creek Industries, Inc., Lexington, Ky.

[21] Appl. No.: 235,158

[22] Filed: Aug. 23, 1988

[51] Int. Cl.[5] ..... B03B 7/00

[52] U.S. Cl. ..... 209/2; 44/626; 44/627; 209/11; 209/12; 209/18

[58] Field of Search ..... 209/1-3, 209/10-13, 17, 18; 44/608, 620, 621, 626, 627

[56] References Cited

U.S. PATENT DOCUMENTS

| | | | |
|---|---|---|---|
| 1,780,830 | 11/1930 | Lessing | 44/627 X |
| 2,446,140 | 7/1948 | McGee | 209/11 X |
| 3,261,463 | 7/1966 | Eveson et al. | 209/11 |
| 3,579,442 | 5/1971 | Gerwig | 44/626 X |
| 3,985,517 | 10/1976 | Johnson | 44/626 X |
| 4,059,060 | 11/1977 | Gambs et al. | 44/627 X |
| 4,146,366 | 3/1979 | Keller | 44/608 |
| 4,198,289 | 4/1980 | Elliott et al. | 209/11 |
| 4,324,560 | 4/1982 | Fonseca | 44/622 X |
| 4,325,819 | 4/1982 | Altizer | 209/12 X |
| 4,582,512 | 4/1986 | Smit et al. | 44/627 X |
| 4,810,258 | 3/1989 | Greene | 44/627 X |

*Primary Examiner*—Margaret A. Focarino
*Assistant Examiner*—Edward M. Wacyra
*Attorney, Agent, or Firm*—Richard C. Litman

[57] ABSTRACT

A process for recovery of combustionable coal from fine coal such as frequently considered waste coal from mining operations includes drying and classifying the raw coal into ultra-fine and fine size classes. The ultra-fine size class is directed to a collector and further separated in a strictly dry manner while the fine size class is separated in a flotation apparatus to divide out the coal and ash therein which are subsequently screened, with or without washing and drying at that time. The screened fine size coal, after being dried, is collected in a stock pile, as is also any dry ultra-fine size coal as discharged by the collector.

6 Claims, 2 Drawing Sheets

METHOD FOR PROCESSING FINE COAL

FIELD OF THE INVENTION

This invention relates generally to the washing of coal and in particular, to an improved method of separating ultra-fine grades of coal including the separation of these fine grades from ash included therewith.

BACKGROUND OF THE INVENTION

There exists in the coal industry an increasing need for a process to clean and wash fine coal. This fine coal can be defined as particulate coal ranging in size from 0 to 14 inch and may be further classified into two categories: namely classified fine coal (28 mesh to 14 inch), and classified ultrafine coal (0 to 28 mesh). Coal particles within the fine range are being produced in larger and larger quantities due to the increased use of continuous mining operations. In addition, current economic trends in the energy market make it more feasible to reprocess the waste piles from previous coal processing operations to recover the fine coal particles that have been discarded and until the present invention have not been economically recoverable.

Raw coal may be processed by a number of methods which may include: crushing, jig washing, dense media washing, sifting, flotation, centrifuging, magnetic separation and drying. The first of these processes crushing, leaves the coal in an assortment of particles and lumps which may range from microscopic to several inches in size. At this point in the process the raw coal still contains a large percentage of undesirable matter commonly referred to as ash. This ash must be separated from the coal as efficiently as possible to obtain a pure coal product suitable for combustion. The aforementioned washing, sifting, flotation, centrifuging, and drying are techniques used to separate the coal from the ash and to prepare the coal for combustion. These separation techniques can be divided into two categories, wet processes and dry processes.

Dry processes generally include dry cyclones, sifting, and shaker tables such as the vibratory screen as disclosed in U.S. Pat. No. 3,113,098 issued Dec. 3, 1963 to Ffoulkes. U.S. Pat. No. 3,901,794 issued Aug. 26, 1975 to Hemme et al. discloses an example of a circulatory air sifter of the type that may be employed in dry coal processing or similar operations.

Wet processes generally include jig washing, dense media flotation and cyclones. Most wet processes also include various recovery and filtering systems in order to efficiently recycle the fluid used in the process.

The large majority of current coal processing plants use a wet process to clean the coal. Ultra-fine particles that enter into the wet processes cause inherent problems in subsequent handling of the fluids used in these wet processes. The fluid circuits in such processes become unwieldy and costly. One such example can be found in U.S. Pat. No. 4,217,207 dated Aug. 12, 1980 and issued to Liller. Thus, there does not exist in the art, an efficient method to eliminate the ultra fine particles in a wet process.

Past coal processing plants have discarded a large amount of fine coal particles along with the separated ash and debris. Current economic trends in the energy market dictate that a feasible process is needed to reprocess fine coal from waste piles of previous coal operations in order to recover the fine coal which is present therein.

SUMMARY OF THE INVENTION

By the present invention, a method for processing fine coal is provided in which the raw coal feed is first dried and classified into two size categories fines (28 mesh and larger) and ultra-fines less than 28 mesh). The drying and classifying is followed by separate cleaning and recovery processes for the fines and the ultra-fines. The fines are cleaned using a wet process with a flotation rank and subsequent drying while the ultra-fines are recovered using a dry cyclone.

Accordingly it is one of the objects of the present invention to provide a method of classifying and cleaning fine coal, which eliminates the ultra fines from any wet processes.

It is a further object of this invention to provide a method which will make it possible more efficiently to recover the fines from the waste piles of previous coal processing operations.

Yet another object of this invention is to provide a method for processing coal which results in a relatively dry and easy to handle waste product.

With these and other objects in view which will more readily appear as the nature of the invention is better understood, the invention consists in the novel combination and arrangement of parts hereinafter more fully described, illustrated and claimed with reference being made to the attached drawings.

DESCRIPTION OF THE PREFERRED EMBODIMENT

Figure 1:
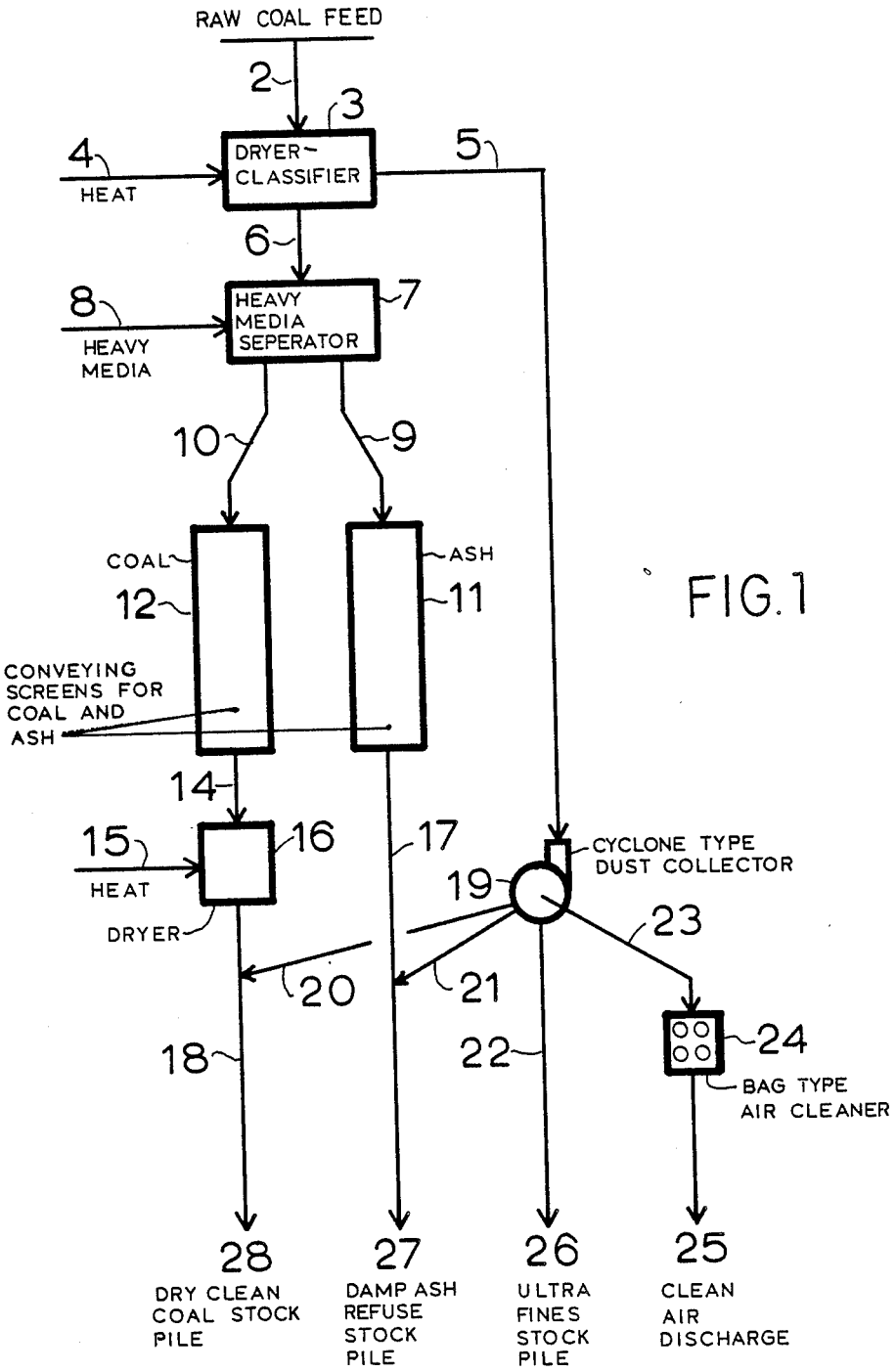
FIG. 1 is a block diagram illustrating the sequence of stages employed in the preferred method of the present invention.

Referring now to the drawings, particularly FIG. 1, a raw coal feed consisting of various sizes of particulate coal and ash and generally ranging in sizes of from 0 to ¾ inches but it will be understood not to be limited to these sizes is fed into a dryer/classifier 3. The raw coal is fed into dryer/classifier 3 by means of an input transporter or regulated feed mechanism 2 such as a vibrating feeder, screw feeder, belt conveyor, or other means as are well known in the art and need nor be specifically illustrated herein. The dryer /classifier 3 according to a preferred embodiment of the present invention is of the fluidized-bed type and is provided with heat from an outside hearing source 4 which supplies the heat for all drying needs within the process of this invention. The dryer/classifier 3 dries the raw coal feed to reduce the moisture content therein and classifies the coal feed into two size categories with the breaking point between the categories being at about 28 mesh. The two size categories of raw coal feed include a smaller size class of coal hereafter referred to as "ultra-fine" coal, comprising particulate matter substantially 28 mesh and smaller and a larger size class of coal comprising particulate matter substantially 28 mesh and larger is hereafter referred to as "fine" coal.

The ultra-fines which have been separated from the fines by the classifier 3 are diverted and transported to a dry cyclone separator 19 through a duct 5 by such means as may be determined most practical by the individual user of this invention. The cyclone apparatus 19 separates the ultra-fines from the fluidizing air stream and has a selective output to enable the user to collect the ultra-fines in a bag type collector or to mix the ultra-fine coal and any other produces separated by the device 19 with one of the output streams from the classified fines cleaning process as described hereinafter. In any case, the air, by which the collector 19 is operated, will be understood to be discharged through a conduit 23 directed to a suitable bag, or other type air cleaner 24 insuring that acceptable clean air is released to the atmosphere as ar 25.

The fines from the dryer/classifier 3 are transported by a suitable conveyor 6 to a heavy media separator 7, wherein the coal fines are contacted with a fluid media. The separator 7 will be understood to be of the flotation type wherein the fluid media used will be of a specific gravity that will allow the ash and other undesirable particles to sink and allow the coal to float. The wet ash, which has settled to the bottom, then flows as a slurry, from a bottom discharge through a trough 9 to an ash screen conveyor 11 of the type retaining and transporting the delivered ash while allowing excess fluid media to pass therethrough and be collected for re-cycling through the separator 7.

The lower density coal in the flotation separator 7 floats over a weir not shown) therein and is discharged likewise as a slurry, to a trough 10 leading to a conveyor 12. The two conveyers 11 and 12 are of the vibrating type and each employs a fine bar (close opening) screen. As in the case of conveying screen 11, the collected fluid media from the screen mechanism 12 in re-cycled to the separator 7. These screens 11,12 perform the function of conveying the ash or coal respectively, while draining the excess fluid media resulting from the flotation procedure.

The screened products in each of the units 11 and 12 may be washed and dried before leaving the conveying screens. Well known water sprayers (not shown) may be employed, together with hear from the same unitary source as providing the heat 4.

Following the above screening, the ash is then transported by any suitable conveying means 17 to a refuse stock pile 27 for disposal. The classified fine coal from the screening mechanism 12 is transported by a chute or conveyor belt 14 to a dryer 16 which is supplied with heat 15 from the same external heat source which supplies the heat 4 for the dryer/classifier 3 used at the start of the process. The clean, dry classified fine coal output of the final dryer 16 is transported by appropriate conveyor means 18 to a stock pile 28 of dry, clean coal, suitable for combustion.

As previously mentioned, the collector apparatus 19 provides a plurality of selective and proportional outputs. As shown in FIG. 1, the collected or separated ultra-fines may be totally or partially directed, by way of appropriate conveyor means 22, to an ultra-fines stock pile 26. Alternately the ultra fines maybe totally or partially directed, by a conveyor 21 to the conveyor 17 leading to the damp ash refuse stock pile 27, or similarly, by conveyor 20, to the conveyor 18 leading to the dry clean coal stock pile 28. Mixing the ultra-fines with the dry clean coal enables the user of this process to adjust the BTU content of the final product to account for the buyers' needs. In the foregoing manner, it will be appreciated that an improved process is provided wherein maximum recovery of all usable components of the raw coal feed is achieved. According to this preferred embodiment, it is recommended that a portion of the ultra-fines which are output from the cyclone 19 be used for heat generation in an outside heat source to supply heat 4 and 15 for the dryer classifier 3 and dryer 16. The process is not to be limited to the use of the ultra-fines for hear generation but may include the use of other commercially available fuels as may be dictated by individual applications.

Figure 2:
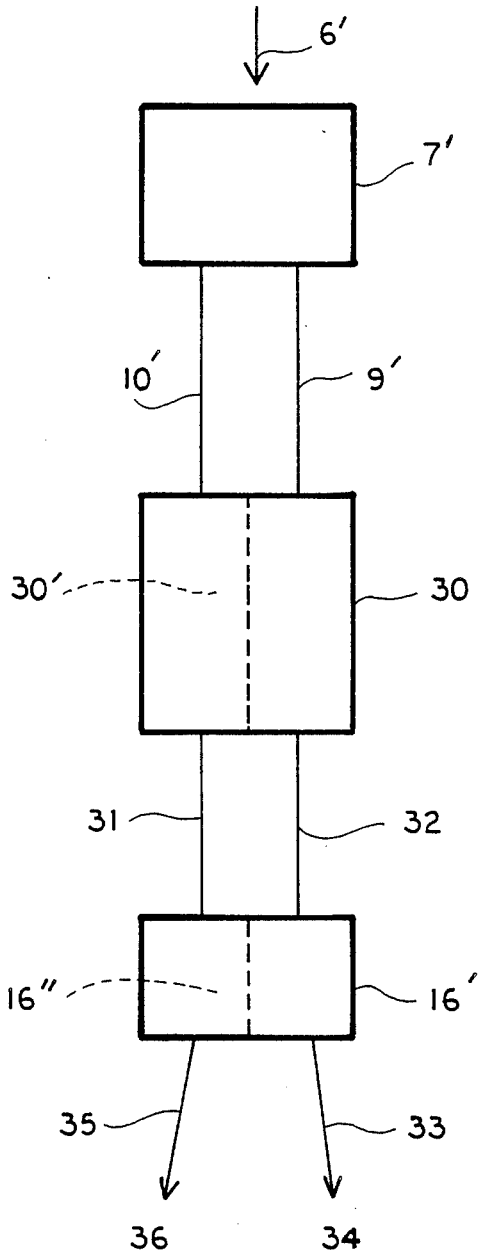
FIG. 2 is a block diagram of an alternate embodiment of the present method.

An alternative embodiment of the present invention is illustrated in the block diagram of FIG. 2, wherein coal fines from the aforementioned dryer/classifier are transported by conveyor 6' to separator 7' for further processing. The ash which settles to the bottom of the heavy media flotation separator 7' flows through a trough 9' to a conveyor 30, while the fine coal floating in the flotation tank passes over a weir therein and through a trough 10' which transports the coal to the screen conveyor 30. Conveyor 30 likewise is a vibrating screen type conveyor with a fine bar (close opening) screen which enables the recovery and re-cycling of remaining media from the media separation process. The conveyor 30, a common conveyor with a longitudinally disposed divider 30' such that the screen simultaneously transfers in a parallel manner, both the coal and ash products which are then directed, by mean of transporting means 31 and 32 to a common dryer 16', likewise having dividing means 16'' to maintain separation of the coal and ash during the drying process. The dryer is supplied with heat from the same heat source used for the initial dryer/classifier operation at the start of the process. A terminal conveyor 33 removes the dry ash from the dryer 16' and transports it to a refuse stock pile 34 for disposal. A second terminal conveyor 35 transports the clean dry coal to a stock pile 36 for the final product to be used for combustion.

It is to be understood that the present invention is not limited to the embodiments described above, but encompasses any and all modifications within the scope of the claims appended hereto.

We claim:

1. A method for processing a raw coal feed consisting of various sizes of particulate coal and ash ranging in sizes of from 0 to about ¾ inches, comprising:

drying the raw coal feed by heating means and concurrently classifying said raw coal feed into a first size class of ultra-fine particulate matter substantially 28 mesh and smaller and a second size class of fine particulate matter substantially 28 mesh and larger by air classifying means;

separating said dried and classified raw coal feed into said first size of particulate matter and collecting ultra-fine particles of coal and ash of 28 mesh size and smaller contained therein and said second size class of fine particulate matter retaining fine particles of coal and ash of 28 mesh and larger;

contacting said second size class of particulate matter with a fluid media in a flotation separator, wherein said fluid media has a specific gravity which allows coal contained therein to float and the ash and other components of the particulate matter are allowed to sink;

recovering said coal and ash as separate slurries;

draining excess fluid media from said separate slurries of coal and ash by means of conveyor screens and collecting said ash as refuse;

drying said coal by heating means; and collecting a dry, clean product of coal fines greater than 28 mesh suitable for combustion.

2. The method according to claim 1 wherein said dry, clean product of coal fines consists of coal particles ranging in size of 28 mesh to ¼ inch.

3. The method according to claim 1 wherein said excess fluid media is collected and recycled to said flotation separator.

4. The method according to claim 1 wherein said slurries of coal and ash are washed by means of water sprayers before leaving the conveyor screens.

5. The method according to claim 4 wherein said ash after being washed is dried by heating means.

6. The method according to claim 1 wherein the ultra-fines collected and said dry, clean product of coal fines are mixed to adjust the BTU content of the resulting coal mixture.

* * * * *